US005234159A

United States Patent [19]

Lorence et al.

[11] Patent Number: 5,234,159

[45] Date of Patent: * Aug. 10, 1993

[54] CONTAINER/LID ASSEMBLY

[75] Inventors: Matthew W. Lorence; Brian D. Hopkins; James E. Grace, all of Omaha, Nebr.

[73] Assignee: Conagra, Inc., Omaha, Nebr.

[ * ] Notice: The portion of the term of this patent subsequent to Feb. 25, 2009 has been disclaimed.

[21] Appl. No.: 840,295

[22] Filed: Feb. 24, 1992

Related U.S. Application Data

[63] Continuation-in-part of Ser. No. 640,646, Jan. 14, 1991, Pat. No. 5,090,615.

[51] Int. Cl.[5] ..... B65D 43/08

[52] U.S. Cl. ..... 229/125.35; 206/557

[58] Field of Search ..... 229/232, 231, 125.35, 229/125.33, 123.1; 206/557, 554

[56] References Cited

U.S. PATENT DOCUMENTS

| | | | |
|---|---|---|---|
| 3,349,985 | 10/1967 | Salway | 229/232 |
| 3,415,662 | 10/1968 | Koger et al. . | |
| 3,495,758 | 2/1970 | Wienecke, Jr. | 229/125.35 |
| 3,730,338 | 5/1973 | Chesky | 206/557 |
| 3,759,720 | 9/1973 | Young . | |
| 3,868,017 | 2/1975 | Carveth | 229/40 |
| 3,924,013 | 12/1975 | Kane . | |
| 4,252,268 | 2/1981 | Haire . | |
| 4,257,530 | 3/1981 | Faller . | |
| 4,343,858 | 8/1982 | Thompson . | |
| 4,351,997 | 9/1982 | Mattisson et al. . | |
| 4,355,721 | 10/1982 | Knott, II et al. . | |
| 4,418,119 | 11/1983 | Morrow et al. . | |
| 4,456,164 | 6/1984 | Foster et al. . | |
| 4,463,029 | 7/1984 | Nishijima et al. . | |
| 4,469,258 | 9/1984 | Wright et al. . | |
| 4,505,961 | 3/1985 | Lu . | |
| 4,505,962 | 3/1985 | Lu . | |
| 4,592,914 | 6/1986 | Kuchenbecker . | |
| 4,595,611 | 6/1986 | Quick et al. . | |
| 4,757,940 | 7/1988 | Quick et al. . | |
| 4,794,027 | 12/1988 | Hering . | |
| 4,821,884 | 4/1989 | Griffin et al. | 206/557 |
| 4,834,247 | 5/1989 | Oshima et al. . | |
| 4,880,112 | 11/1989 | Conrad | 206/457 |
| 4,889,239 | 12/1989 | Sandish et al. . | |
| 4,890,439 | 1/1990 | Smart et al. . | |
| 4,900,594 | 2/1990 | Quick et al. . | |
| 4,903,842 | 2/1990 | Tokuda et al. | 229/125.35 |
| 4,925,035 | 5/1990 | Hunninghaus . | |
| 4,939,332 | 7/1990 | Hahn . | |
| 4,955,530 | 9/1990 | Rigby et al. | 229/125.35 |
| 4,962,849 | 10/1990 | Anderson | 229/125.35 |
| 5,002,833 | 3/1991 | Kinsey, Jr. et al. . | |
| 5,011,006 | 4/1991 | Anderson | 229/125.35 |
| 5,090,615 | 2/1992 | Hopkins | 229/125.33 |

*Primary Examiner*—Allan N. Shoap
*Assistant Examiner*—Christopher McDonald
*Attorney, Agent, or Firm*—Willian Brinks Olds Hofer Gilson & Lione

[57] ABSTRACT

A package of the type having a container with a bottom surface, a peripheral wall, and a peripheral lip includes a seal secured to the peripheral lip and a cover positioned to overlie the seal and the peripheral lip. The cover includes two oppositely disposed side flaps oriented to extend away from the peripheral lip toward the bottom surface, and two bottom flaps each secured to a respective one of the two side flaps and to the bottom surface.

28 Claims, 5 Drawing Sheets

FIG. 1
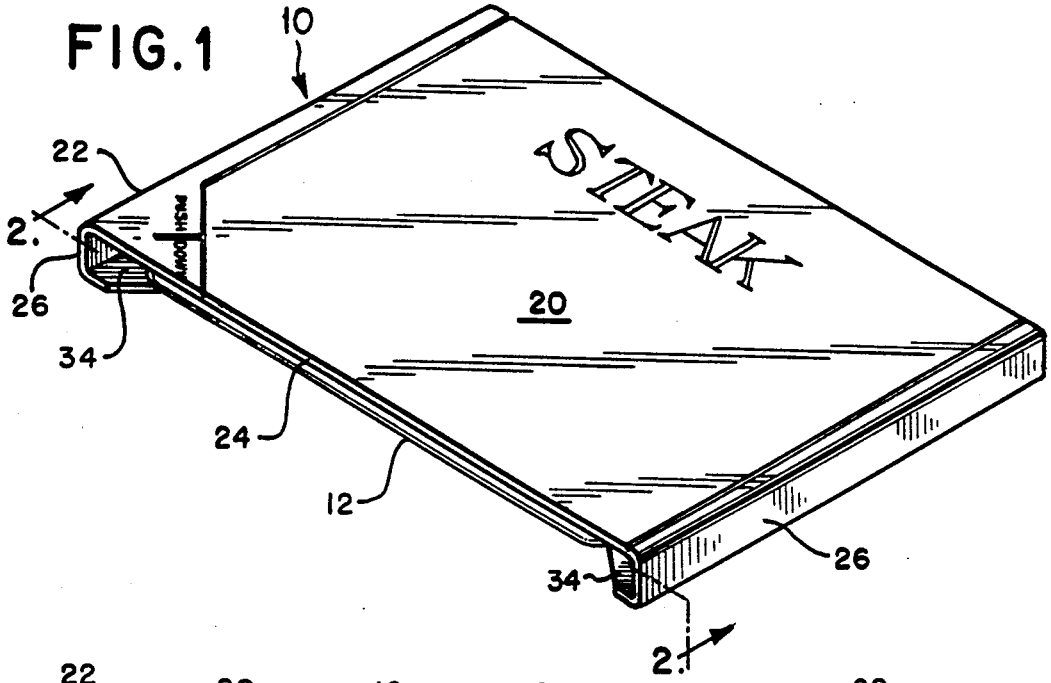
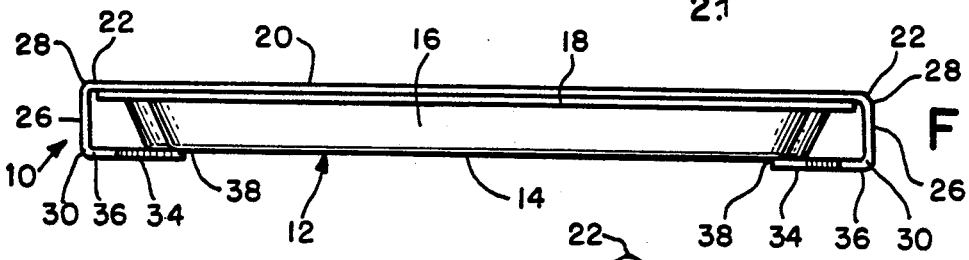
FIG. 2
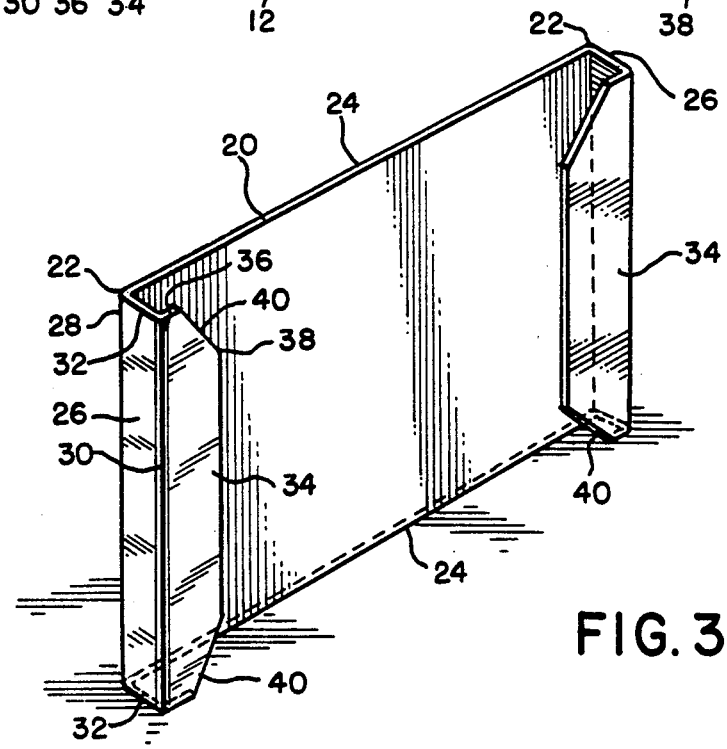
FIG. 3

60'

60''

CONTAINER/LID ASSEMBLY

CROSS-REFERENCE TO RELATED APPLICATION

This application is a continuation-in-part of our copending patent application, Ser. No 07/640,646, filed on Jan. 14, 1991 now U.S. Pat. No. 5,090,615.

BACKGROUND OF THE INVENTION

This invention relates to packages of the type having a container comprising a bottom surface, a peripheral wall surrounding the bottom surface, and a peripheral lip surrounding the peripheral wall, wherein the container includes a cover positioned over the container lip. The cover may act to seal the container, or a separate seal may be positioned between the cover and the peripheral lip.

Wienecke U.S. Pat. No. 3,495,758 discloses one package of the general type described above. In the Wienecke package the lid 14 is provided with edge flaps 22, 18; 32, 31; 43, 48 which extend between the upper and lower surfaces of the container. The center portion of the lid is secured to the peripheral lip of the container, and the edge flaps of the lid are secured to the bottom surface of the container.

The container lid disclosed in the Wienecke patent accomplishes the stated objective of increasing the label area in a cost effective manner. However, the Wienecke lid exhibits certain disadvantages. In the arrangement shown in FIG. 2 the central lid 21 and the flaps 22, 18 are all equal in width. When such a lid is used with a container having tapered side walls as shown in FIG. 4, there is a tendency for the corner of the lid at the flap 18 to protrude objectionably and provide a snagging corner. The lids shown in FIGS. 5 and 6 of Wienecke solve this problem. However, the lids of FIGS. 5 and 6 are not well suited to support the container in an upright position when resting on one edge or to provide a stable pushing surface. Because both the flaps 31 and 32 taper progressively away from the side edge of the central lid 31, the flaps 31, 32 will allow the container to tip rearwardly if an attempt is made to stand the container on its edge or to move vertically if multiple containers are pushed together while being conveyed.

Furthermore, the preferred arrangement of the Wienecke patent angles the side flap 22 inwardly as shown in FIG. 4, such that the side flap 22 is disposed at an acute angle with respect to the center lid 21. This orientation for the side flap 22 can make it more difficult to push a row of adjacent containers as they are conveyed throughout a plant due to the lack of vertical pushing surfaces between containers.

It is a primary object of this invention to provide an improved container which largely or completely overcomes the aforementioned disadvantages of the Wienecke patent.

SUMMARY OF THE INVENTION

According to a first aspect of this invention, a package of the type described initially above is provided with at least one side flap secured to the cover, and at least one bottom flap secured between the side flap and the bottom surface. The side and bottom flaps are configured to support the package in a stable configuration when resting on the side edges of the cover and the side flap, while avoiding snagging problems associated with the bottom flap. This can be done by forming the first and second edges of the side flap and the first edge of the bottom flap of equal length and longer than the second edge of the bottom flap secured to the bottom surface. Preferably, the side edges of the cover and the side flap define a plane oriented substantially perpendicular to the cover such that the package is stable when resting on the side edges of the cover and the side flap, and at least a portion of the side edge of the bottom flap is angled away from the plane defined by the side edges of the cover and the side flap, toward the bottom surface.

According to a second aspect of this invention a package of the type described initially above is provided with at least one side flap secured to the cover and oriented to extend toward the bottom surface and at least one bottom flap secured to the side flap and to the bottom surface. The bottom flap is oriented substantially parallel to the cover, and the side flap is oriented substantially perpendicular to the bottom flap and to the cover.

BRIEF DESCRIPTION OF THE DRAWINGS

FIG. 1 is a perspective view of a package which incorporates a first preferred embodiment of this invention.

FIG. 2 is a side view taken along line 2—2 of FIG. 1.

FIG. 3 is a perspective view showing the lid of the package of FIG. 1 resting on the side surfaces of the lid and side flaps, with the container deleted for clarity of illustration.

DETAILED DESCRIPTION OF THE PRESENTLY PREFERRED EMBODIMENTS

Figure 4:
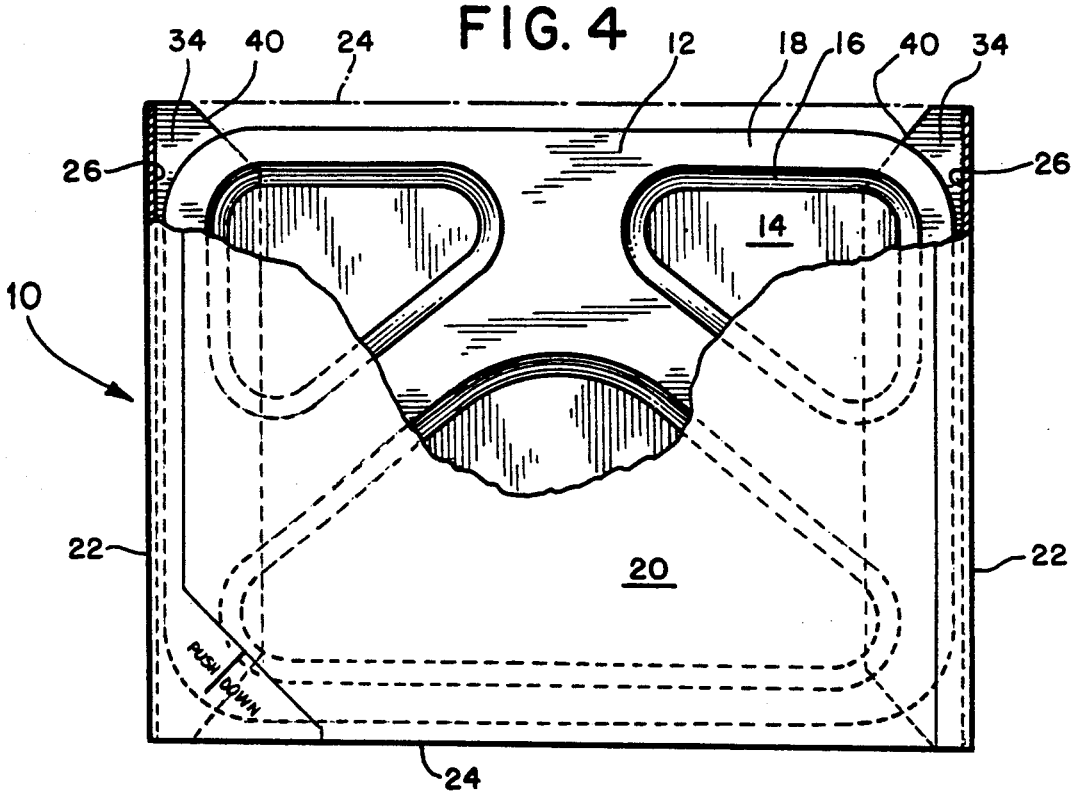
FIG. 4 is a top view of the package of FIG. 1.
Figure 5:
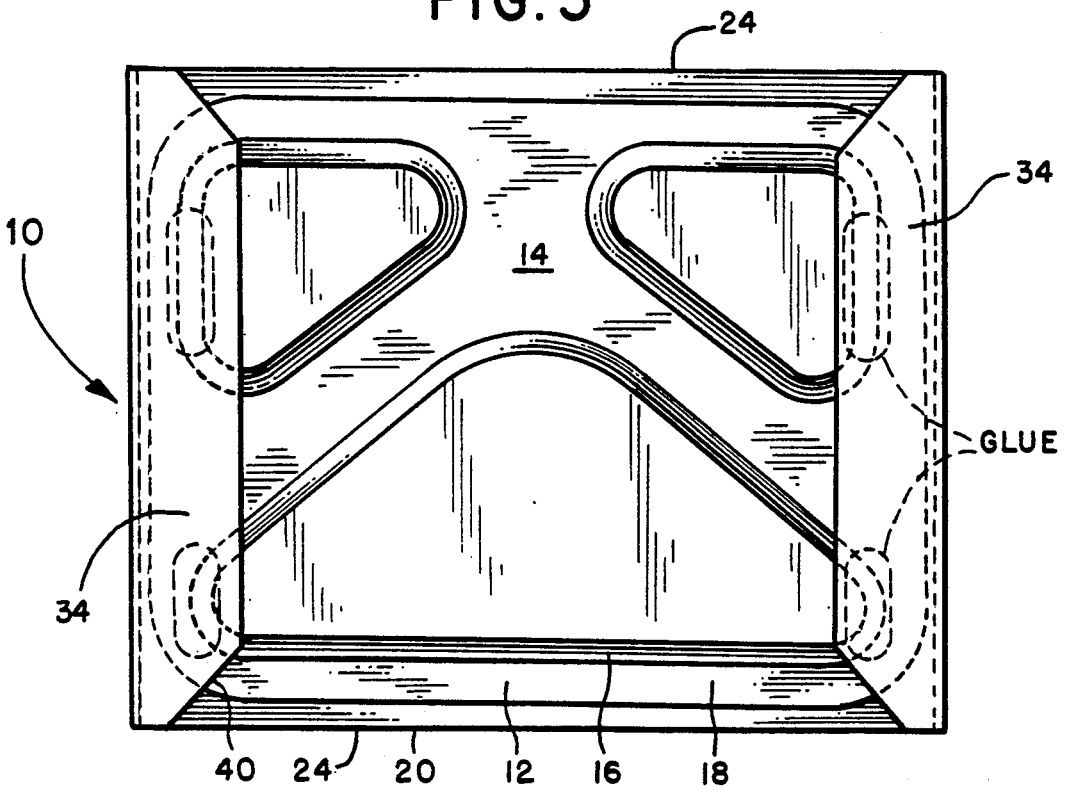
FIG. 5 is a bottom view of the package of FIG. 1.

Turning now to the drawings, FIGS. 1–5 show various views of a package 10 which incorporates a first preferred embodiment of this invention. The package 10 includes a tray shaped container 12 having a bottom surface 14 which is surrounded by an upstanding peripheral wall 16 that terminates in a peripheral lip 18. The container 12 may for example be a tray suitable for use with a T.V. dinner.

The package 10 also includes a lid 22 having shorter end edges 22 and longer side edges 24 (FIGS. 1–5). The end edges 22 are connected to side flaps 26. Each of the side flaps 26 defines a first side flap edge 28, a second side flap edge 30 and a wide edge 32 extending therebetween. Each of the side flaps 26 is in turn connected to a bottom flap 34, and each of the bottom flaps 34 defines a first bottom flap edge 36, a second bottom flap edge 38 and a side bottom flap edge 40 extending therebetween. The lip 20 defines score lines 50 at which the lid is cut to 50% its thickness. The score lines 50 form an opening feature that allows a user to remove the central portion of the lid 20 easily in order to gain access to the contents of the package 10. Preferably the outer score line is formed on the outer, printed side of the lid 20 and the inner score line is formed on the inner, unprinted side of the lid 20.

Figure 6A:
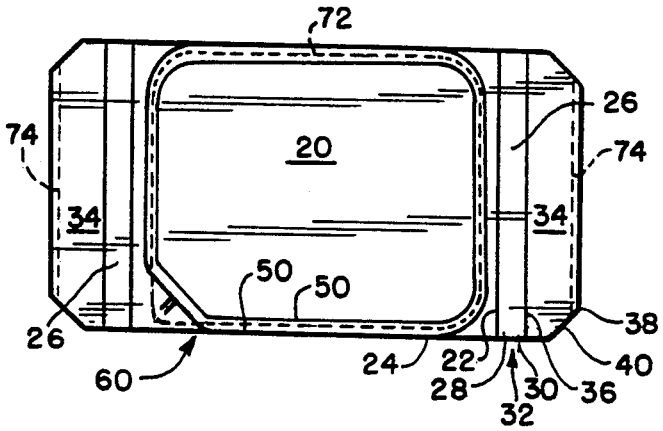
FIG. 6*a* is a plan view of an unfolded blank used in the manufacture of the package of FIG. 1.

As shown in FIG. 6*a*, the lid 20, side flaps 26 and bottom flaps 34 are preferably formed as a one piece integral sheet. Reference numeral 60 is used to indicate the unfolded blank. The blank 60 is folded as shown in FIG. 1, and the lid 20 is secured to the peripheral lip 18 at a bonding line 72, and the second edges 38 of the bottom flaps 34 are secured to the bottom surface 14 at selected locations along bonding lines 74.

As best shown in FIGS. 1 and 3, the lid 20 has been designed so as to brace the package 10 when stoop up on edge. Note that the side edge 24 of the lid 20 and the side edges 32 of the side flaps 26 define a plane, and that portions of the side edges 40 of the bottom flaps 34 lie in this plane. Of course, the side edges 32, 40 could be notched or recessed in part and still define the desired plane. These side edges support the package 10 when stood up on edge, with the side edges 24, 32, 40 in contact with the support surface (not shown). Additionally, the coplanar side edges 24, 32, 40 provide stable pushing surfaces when the packages 10 are pushed in a row of adjacent packages. These advantageous results are obtained without protruding corners that are easily snagged. This is because the side edges 40 are in part angled away from the support plane, toward the bottom surface 14. In this way, both objectives are met. As best shown in FIG. 6*a*, the first and second edges 28, 30 of the side flaps 26 are equal in length to the side edges 24 of the lid 20, but are longer than the second edges 38 of the bottom flaps 34.

As shown in FIG. 2, the bottom flap 34 is parallel to the lid 20, and the side flap 26 is perpendicular to the lid 20. This arrangement has been found to provide a number of important advantages. First, since the side flaps 26 are oriented vertically when the package 10 is oriented as shown in FIG. 2, stacking strength is increased as compared with a package with angled side flaps.

Second, when two or more of the packages 10 are stacked one above the other, the side flaps 26 transmit much of the weight from the side flap 26 of an upper package to the side flap 26 of a lower package. In this way, much of the weight is supported away from the score line 50. In the past, it has been found that in the absence of vertical side flaps 26 as shown in FIG. 2, the weight of stacked packages can actually rupture the lid at the score line 50. The disclosed structure avoids this problem to a large extent.

Third, even after the central panel of the lid 20 is removed at the score line 50, the side flaps 26 and bottom flaps 34 cooperate with remaining portions of the lid 20 to rigidify the tray and make it easier to carry and use without spilling its contents.

Fourth, when the side flaps 26 are oriented vertically as shown in FIG. 2 the packages 10 can easily be pushed in a row of adjacent packages, one behind the other. The vertical side flaps 26 provide stable pushing surfaces, and substantially reduce any tendency of the packages to move vertically when conveyed.

Figure 6B:
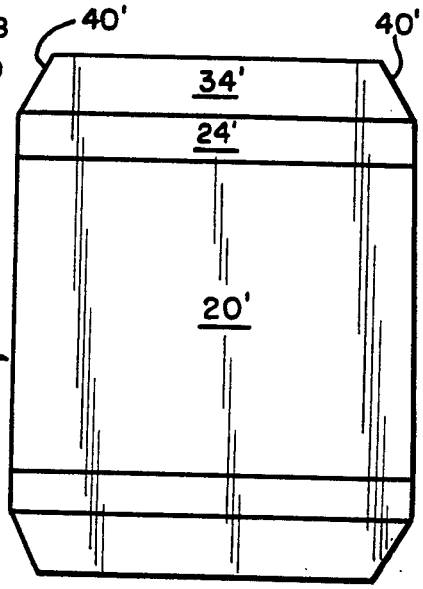
FIGS. 6*b*–6*d* are plan views of unfolded blanks of three alternative embodiments.
Figure 6D:
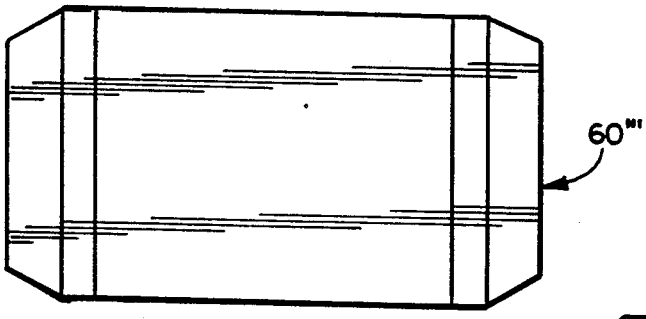
Figure 6C:
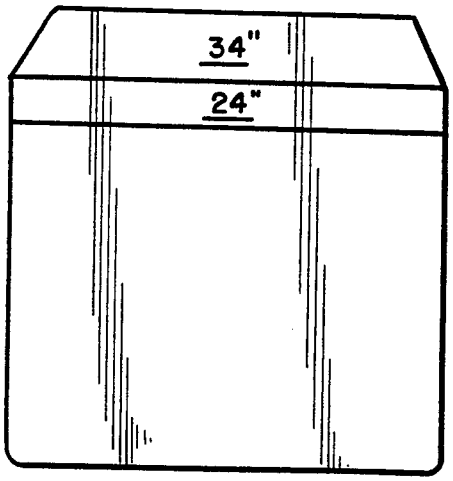

FIGS. 6*b*–6*d* show unfolded blanks 60', 60'', 60''' of three alternative embodiments. In the blank 60' of FIG. 6*b* the entire side edge 40' of the bottom flap 34' angles away from the plane defined by the side edges of the side flaps 24' and lid 20'.

The blank 60'' of FIG. 6*c* is similar to that of the blank 60' described above, except that only a single side flap 24'' and only a single bottom flap 34'' are provided.

The unfolded blank 60''' of FIG. 6*d* is also similar to the blank 60' described above, except the proportions have been varied somewhat.

FIGS. 7–11 show various views of a package 10 which incorporates a second preferred embodiment of this invention. The package 10 includes a tray-shaped container 12 having a bottom surface 14 which is surrounded by a peripheral wall 16 that terminates in a peripheral lip 18.

The package 10 also includes a seal (indicated at 19 in FIG. 9) secured to the peripheral lip 18. The seal 19 seals the contents of the package 10 within the container 12 and may be formed of polyester film, foil, or other lidding materials common to the industry.

Figure 7:
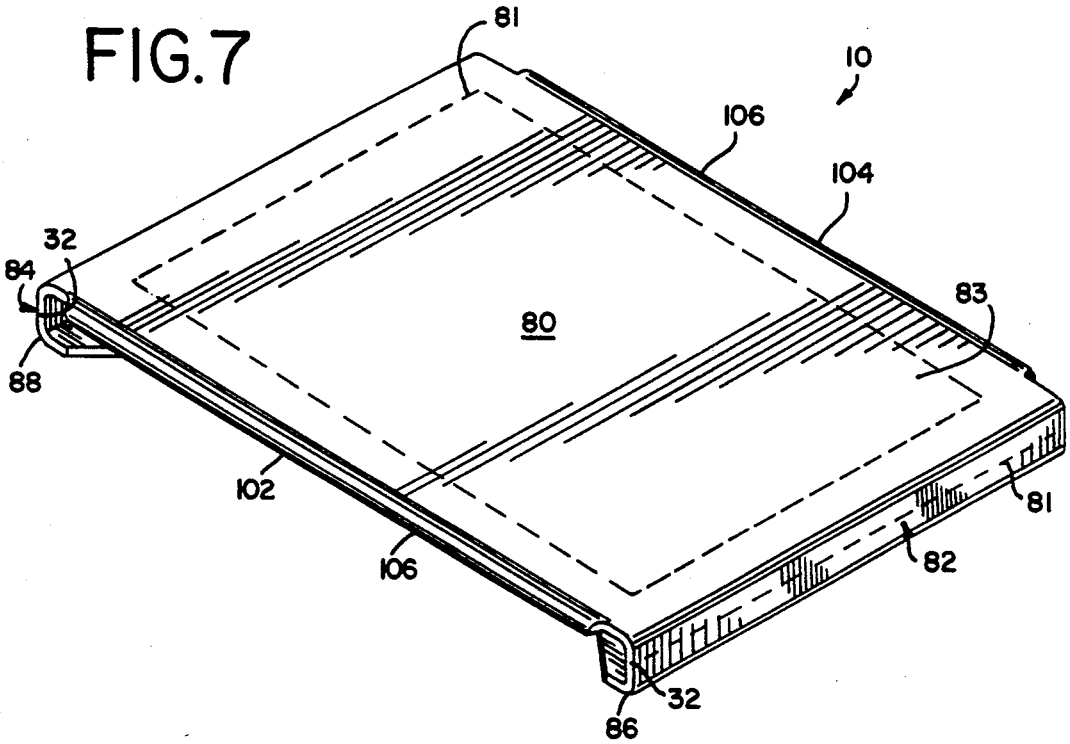
FIG. 7 is a perspective view of a package that incorporates another preferred embodiment of this invention.
Figure 8:
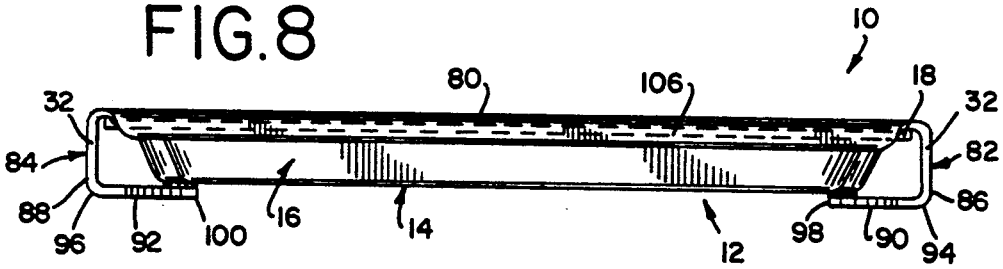
FIG. 8 is a front view of the package of FIG. 7.
Figure 9:
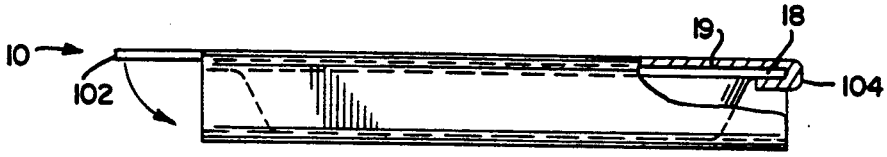
FIG. 9 is a side view of the package of FIG. 7 with a cutaway portion showing a leading edge of the cover disposed around the outside of the container lip.
Figure 10:
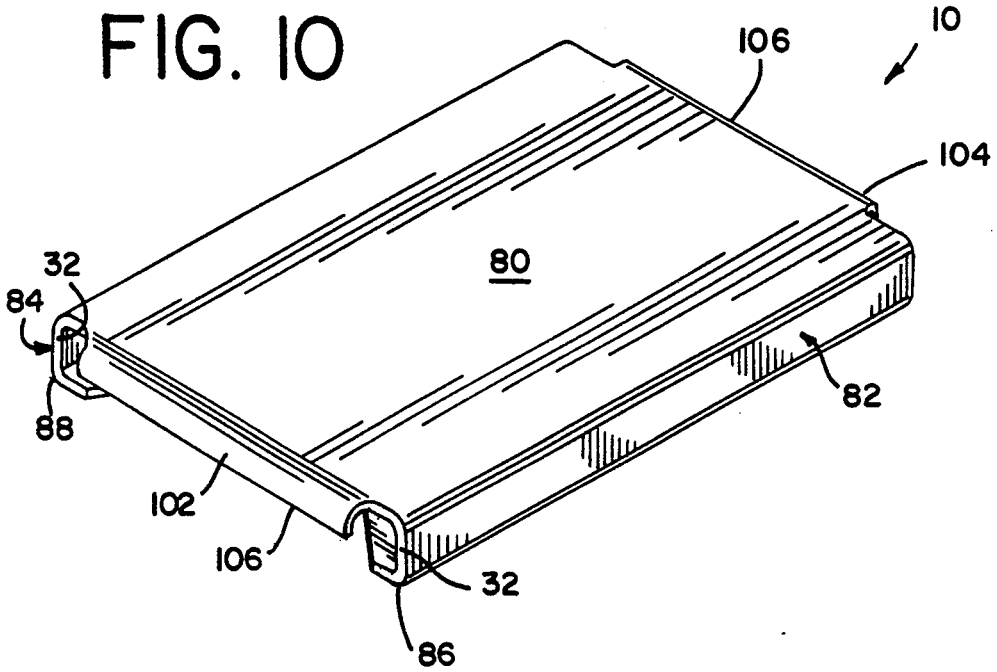
FIG. 10 is a perspective view of a package that incorporates yet another preferred embodiment of this invention.

Resting atop the seal 19 is a lid or cover 80. The cover 80 has secured to it two oppositely disposed side flaps 82, 84 each having a respective edge 86, 88, and two bottom flaps 90, 92 each having a first edge 94, 96 and a second edge 98, 100. As shown in FIGS. 7 and 10, the two oppositely disposed side flaps 82, 84 may correspond to either the long sides or the short sides of the container 12. The first edge 94, 96 of each of the two bottom flaps 90, 92 is secured to the edge 86, 88 of the respective side flap 82, 84, and the second edge 98, 100 of each of the bottom flaps 90, 92 is secured to the bottom surface 14. The cover 80, side flaps 82, 84 and bottom flaps 90, 92 may be formed in one piece. Furthermore, the cover 80 may define an opening feature 81 located along either the side flaps 82, 84, the bottom flaps 90, 92 (not shown) or the top surface 83 of the cover 80.

In the embodiment of FIGS. 7–11, the cover 80, by resting atop the seal 19, protects the seal from damage. If desired the cover 80 is easily removed from the package 10 by disengaging the bottom flaps 90, 92 from the bottom surface 14, thereby eliminating the need for the opening feature 81. If, however, the opening feature 81 is utilized, depending on the location of the opening feature 81 as discussed above, remnants of the cover 80 may be left on the container 12. For example, if the opening feature 81 is located along the side flaps 82, 84 as shown in FIG. 7, the bottom flaps 90, 92 will remain secured to the bottom surface 14 of the container 12 when the opening feature 81 is used to remove the cover 80. Preferably, for durability and sturdiness, the cover 80 is formed of paperboard.

Figure 11:
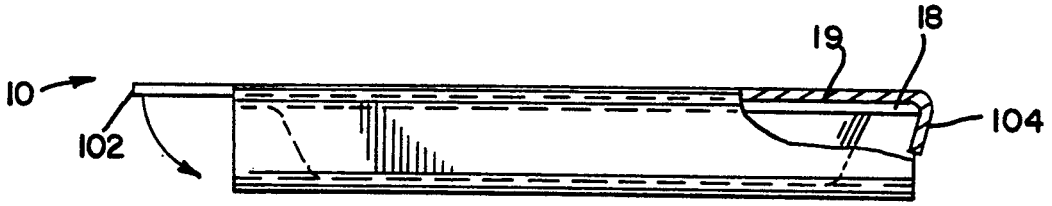
FIG. 11 is a side view of the package of FIG. 10 with a cutaway portion showing a leading edge of the cover oriented to extend away from the container lip toward the bottom surface of the container.

If desired, the cover 80 may further include two oppositely disposed leading edges 102, 104 secured to the peripheral lip 18. The leading edges 102, 104 are positioned on the sides of the cover 80 not having the two side flaps 82, 84. The leading edges 102, 104 may be heat-sealed to the peripheral lip 18, mechanically disposed around the outside of the peripheral lip 18 or, as shown in FIG. 11, oriented to extend away from the peripheral lip 18 toward the bottom surface 14. Securing the leading edges 102, 104 to the peripheral lip 18 prevents tampering with the contents of the package 10 and further protects the lid from damage by preventing objects from entering the package 10 by sliding beneath the cover 80.

As described in the foregoing discussion of the first preferred embodiment, the cover 80, side flaps 82, 84 and bottom flaps 90, 92 may be designed to brace the package 10 when placed on edge. Furthermore, when the cover 80 includes the two leading edges 102, 104, the leading edges 102, 104 may define a side edge 106 that performs the support function of the side edge 24 of the lid 20 shown in FIGS. 1 and 3. This side edge 106 may cooperate with the side edges 32 of the side flaps 82, 84 to support the package 10 when placed on edge.

The following details of construction are provided in order to define the best mode of the invention. Of course, it should be understood that these details are provided only by way of illustration, and that they are not intended to limit the present invention in any way.

The container 12 may be formed of a paper based material such as a milk carton stock supplied by International Paper as liquid packaging board coated on one side with a polyester dual ovenable coating. Alternative materials include molded paper pulp with a polyester coating or any other suitable plastic or paper based material, with or without special coatings, polymers or adhesives. The choice of material will typically be dictated by the application.

The lid 20 is preferably formed of a paperboard material such as a solid bleached sulfate clay coated on one side with a polyester dual ovenable coating to seal to the lip 18 of the container 12. Alternatives include any other suitable plastic or paper based material with or without special coatings, polymers or adhesives. As before, the choice of material will typically be dictated by the application.

Both the container 12 and the lid 20 may be made of materials that are heatable in either a conventional oven or a microwave oven, or alternately material suitable only for microwave heating may be preferred. The thickness of the stock for the container 12 and the lid 20 may range between 0.010 and 0.026 inches. At present a thickness of about 0.018 inch is preferred for the lid 20 and a thickness of about 0.021 inch is preferred for the container 12.

The lid 20 is preferably heat sealed to the lip 18 with the polyester coatings described above. Other sealing approaches may of course be substituted. The bottom flaps 34 are preferably adhered to the bottom surface 14 with a hot melt adhesive such as Swift Adhesive #888-02 (Reichhold Chemical, Swift Adhesive Division) to tack the flaps 34, and a cold vinyl adhesive such as JEDBOND #71-240E (Jedco Chemical Corp). Alternately, either the hot melt or the cold vinyl adhesive may be used alone.

Of course, it should be understood that a wide range of changes and modifications can be made to the preferred embodiments described above. For example, the lid may be tacked to the upper portion of the container at spaced apart locations, and other

We claim:

1. In a package of the type comprising a container comprising a bottom surface, a peripheral wall surrounding the bottom surface, and a peripheral lip surrounding the peripheral wall; the improvement comprising:

a cover positioned to overlie the peripheral lip;

at least one side flap having a first edge secured to the cover and a second edge, the side flap oriented to extend away from the lip toward the bottom surface; and at least one bottom flap having a fist edge secured to the second edge of the side flap and a second edge secured to the bottom surface;

the first and second edges of the side flap and the first edge of the bottom flap being equal in length and longer than the second edge of the bottom flap;

each of said cover, side flap and bottom flap defining at least one side edge; the side edges of the cover and side flap defining a plane inverted substantially perpendicular to the cover such that the package is stable when resting on the side edges of the cover and the side flap.

2. The invention of claim 1 wherein the cover and bottom flap are oriented parallel to one another, and wherein the cover and the side flap are oriented perpendicular to one another.

3. The invention of claim 1 wherein the at least one side flap comprises two opposed side flaps, and wherein the at least one bottom flap comprises two bottom flaps, each secured to a respective one of the side flaps.

4. The invention of claim 1 wherein the container is shaped to define a food tray.

5. The invention of claim 1 wherein the package further comprises a seal disposed between the cover and the peripheral wall, wherein said seal is sealed to the peripheral wall.

6. The invention of claim 1 wherein the cover further comprises two oppositely disposed leading edges oriented to extend away from the peripheral lip toward the bottom surface.

7. The invention of claim 6 wherein the two oppositely disposed leading edges are secured to the peripheral lip.

8. In a package of the type comprising a container comprising a bottom surface, a peripheral wall surrounding the bottom surface, and a peripheral lip surrounding the peripheral wall; the improvement comprising:

a cover positioned to overlie the peripheral lip;

at least one side flap secured to the cover and oriented to extend toward the bottom surface; and at least one bottom flap secured to the side flap and tot he bottom surface;

each of the cover, side flap, and bottom flap defining at least one side edge;

the side edges of the cover and side flap defining a plane oriented substantially perpendicular to the cover such that the package is stable when resting on the side edges of the cover and side flap;

at least a portion of the side edge of the bottom flap angled away from the plane defined by the side edges of the cover and side flap, toward the bottom surface.

9. The invention of claim 8 wherein the cover and bottom flap are oriented parallel to one another, and wherein the cover and the side flap are oriented perpendicular to one another.

10. The invention of claim 8 wherein at least one side flap comprises two opposed side flaps, and wherein at least one bottom flap comprises two bottom flaps, each secured to a respective one of the side flaps.

11. The invention of claim 8 wherein a portion of the side edge of the bottom flap adjacent the side flap is coplanar with the plane defined by the side edges of the cover and side flap.

12. The invention of claim 8 wherein the container is shaped to define a food tray.

13. The invention of claim 8 wherein the package further comprises a seal disposed between the cover and the peripheral wall, wherein said seal is sealed to the peripheral wall.

14. The invention of claim 8 wherein the cover further comprises two oppositely disposed leading edges oriented to extend away from the peripheral lip toward the bottom surface.

15. The invention of claim 14 wherein the two oppositely disposed leading edges are secured to the peripheral lip.

16. In a package of the type comprising a container comprising a bottom surface, a peripheral wall surrounding the bottom surface, and a peripheral lip surrounding the peripheral wall; the improvement comprising:

a cover unadhered to and overlying the peripheral lip;

at least two opposed side flaps secured to the cover and oriented to extend toward the bottom surface; and at least two bottom flaps each secured to a respective one of the side flaps and to the bottom surface, wherein the two bottom flaps are spaced apart from one another;

the bottom flaps oriented substantially parallel to the cover;

the side flaps oriented substantially perpendicular to the bottom flap and to the cover;

each of said bottom flaps extending over less than half of the bottom surface;

said cover defining an opening feature to facilitate removal of said cover from said package.

17. The invention of claim 16 wherein the container is shaped to define a food tray.

18. The invention of claim 16 wherein the opening feature comprises at least one score line.

19. The invention of claim 16 wherein the package further comprises a seal disposed between the cover and the peripheral wall, wherein said seal is sealed to the peripheral wall.

20. The invention of claim 16 wherein the cover further comprises two oppositely disposed leading edges oriented to extend away from the peripheral lip toward the bottom surface.

21. The invention of claim 20 wherein the two oppositely disposed leading edges are secured to the peripheral lip.

22. In a package of the type comprising a container comprising a bottom surface, a peripheral lip surrounding the bottom surface, and a peripheral wall surrounding the peripheral wall; the improvement comprising:

a cover positioned to overlie the peripheral lip, the cover defining a side edge and two opposed end edges;

first and second side flaps, each secured to a respective one of the end edges of the cover; and first and second bottom flaps, each secured to a respective one of the side flaps and to the bottom surface;

the side flaps oriented parallel to one another and perpendicular to the cover;

the side and bottom flaps each defining a respective side edge;

the side edges of the cover and side flaps defining a plane oriented substantially perpendicular to the cover such that the package is stable when resting on the side edges of the cover and side flap;

at least a portion of the side edges of the bottom flaps angled away from the plane defined by the side edges of the cover and side flaps, toward the bottom surface.

23. The invention of claim 22 wherein the container is shaped to define a food tray.

24. The invention of claim 22 wherein a portion of the side edges of the bottom flaps adjacent the respective side flaps is coplanar with the plane defined by the side edges of the cover and side flaps.

25. The invention of claim 22 wherein the side edge of the cover is longer than each of the end edges of the cover.

26. The invention of claim 22 wherein the package further comprises a seal disposed between the cover and the peripheral wall, wherein said seal is sealed to the peripheral wall.

27. The invention of claim 22 wherein the cover further comprises two oppositely disposed leading edges oriented to extend away from the peripheral lip toward the bottom surface.

28. The invention of claim 27 wherein the two oppositely disposed leading edges are secured to the peripheral lip.

* * * * *

UNITED STATES PATENT AND TRADEMARK OFFICE

CERTIFICATE OF CORRECTION

PATENT NO. : 5,234,159

DATED : August 10, 1993

INVENTOR(S) : Matthew W. Lorence et al.

It is certified that error appears in the above-indentified patent and that said Letters Patent is hereby corrected as shown below:

On The Title Page Item [73]

under the heading "Assignee:" please delete "Conagra," and substitute therefor --ConAgra,--.

Under the heading "U.S. PATENT DOCUMENTS", Column 2, line 22, after "Hopkins" please insert --et al.--.

Column 1, line 2, delete "No" and substitute --No.--.

Column 2, line 66, delete "wide" and substitute --side--.

Column 3, line 3, delete "lip" and substitute --lid--.

Column 3, line 21, delete "stoop" and substitute --stood--.

Column 5, line 50, after "Corp" please insert --.--.

Column 5, line 57, after "other" please add --means, such as a film, may be used to seal the container. The bottom flaps may be shaped as desired, and rounded side edges may be preferred. The side and bottom flaps described above may be applied to any combination of the sides of the package, on one, two, three or four sides. It is therefore intended that the

UNITED STATES PATENT AND TRADEMARK OFFICE

CERTIFICATE OF CORRECTION

PATENT NO. : 5,234,159

DATED : August 10, 1993

INVENTOR(S) : Matthew W. Lorence et al.

It is certified that error appears in the above-identified patent and that said Letters Patent is hereby corrected as shown below:

foregoing detailed description be regarded as illustrative rather than limiting, and that it be understood that it is the following claims, including all equivalents, which are intended to define the scope of this invention.--.

Col. 6, Claim 1, line 1, delete "fist" and substitute --first--.

Col. 6, Claim 8, line 44, delete "tot he" and substitute --to the--.

Col. 8, Claim 22, line 5, delete "lip" and substitute --wall--.

Col. 8, Claim 22, line 6, delete "wall" and substitute --lip--.

Signed and Sealed this

Twenty-seventh Day of September, 1994

*Attest:*

Bruce Lehman

BRUCE LEHMAN

*Attesting Officer*

*Commissioner of Patents and Trademarks*